US005860467A

United States Patent [19]

DeSimone et al.

[11] Patent Number: 5,860,467

[45] Date of Patent: Jan. 19, 1999

[54] USE OF $CO_2$-SOLUBLE MATERIALS IN MAKING MOLDS

[75] Inventors: Joseph M. DeSimone, Chapel Hill, N.C.; Esin Gulari, Detroit; Charles Manke, Jr., West Bloomfield, both of Mich.

[73] Assignees: The University of North Carolina at Chapel Hill, Chapel Hill, N.C.; Wayne State University, Detroit, Mich.

[21] Appl. No.: 753,938

[22] Filed: Dec. 3, 1996

[51] Int. Cl.[6] ..... B22C 7/02; B22C 9/04

[52] U.S. Cl. ..... 164/5; 164/34

[58] Field of Search ..... 164/36, 34, 35, 164/5

[56] References Cited

U.S. PATENT DOCUMENTS

| | | | |
|---|---|---|---|
| 4,552,786 | 11/1985 | Berneburg et al. . | |
| 4,731,208 | 3/1988 | Nakajima et al. . | |
| 4,737,332 | 4/1988 | Miyashita et al. . | |
| 4,809,761 | 3/1989 | Nankee et al. | 164/36 X |
| 4,820,462 | 4/1989 | Nakajima et al. . | |
| 4,943,403 | 7/1990 | Miyashita et al. . | |
| 4,944,837 | 7/1990 | Nishikawa et al. . | |
| 5,035,847 | 7/1991 | Nishio et al. | 264/86 |
| 5,059,407 | 10/1991 | Wallace et al. . | |
| 5,296,083 | 3/1994 | Petino | 156/344 |
| 5,436,061 | 7/1995 | Hanneman et al. | 427/208.4 |
| 5,447,577 | 9/1995 | Gao et al. . | |
| 5,501,761 | 3/1996 | Evans et al. | 156/344 |
| 5,607,518 | 3/1997 | Hoffman et al. | 134/31 |
| 5,674,957 | 10/1997 | DeSimone et al. | 526/89 |
| 5,679,737 | 10/1997 | DeSimone et al. . | |

FOREIGN PATENT DOCUMENTS

| | | |
|---|---|---|
| 60-19233 | 9/1985 | Japan . |
| WO 93/20116 | 10/1993 | WIPO . |

*Primary Examiner*—J. Reed Batten, Jr.
*Attorney, Agent, or Firm*—Myers Bigel Sibley & Sajovec, P.A.

[57] ABSTRACT

A structure of $CO_2$-insoluble material has a three-dimensional object of $CO_2$-soluble material positioned inside. The object is contacted with a fluid containing carbon dioxide which dissolves the object in the fluid. The fluid is then removed to form a cavity in the structure.

12 Claims, No Drawings

USE OF $CO_2$-SOLUBLE MATERIALS IN MAKING MOLDS

FIELD OF THE INVENTION

The present invention relates to methods of employing $CO_2$-soluble materials as transient spacers, templates, molds, adhesives, binders, and coatings. More particularly, the invention relates to methods of employing $CO_2$ to remove and dissolve the $CO_2$-soluble materials.

BACKGROUND OF THE INVENTION

Transient spacers, templates, adhesives, binders, coatings, and molds are used in numerous industrial applications. In many applications, it is desirable to remove these materials during or after a manufacturing process. For example, in lost foam and lost wax metal casting technologies, a premade form/template pattern of a part is typically made out of plastic or wax.

The form/template is then used to prepare a casting mold, such as a metal casting mold. Metal casting typically involves one of two different processes. In one process, the form/template is removed leaving a cavity suitable to subsequently receive the molten metal. The cavity is typically created by burning out the form/template by firing the casting mold, or by dissolving the form/template in an appropriate solvent. In the other process, the molten metal is poured into the casting mold, contacting the plastic or wax form/template so as to displace the form/template from the mold. During this process, the form/template burns off from the mold as the molten material causes the form/template to decompose at elevated temperatures.

In spite of the wide spread use of these processes, potential environmental risks exist. For example, when the form/template is burned from the mold, noxious gases are generated and emitted. Moreover, when the form/template is dissolved in a solvent, potentially hazardous organic liquids are often employed as the solvent. It would be desirable to utilize techniques in forming molds and the like which employ materials capable of being displaced which do not utilize the above potentially hazardous techniques.

It is therefore an object of the present invention to provide a method of removing material used in applications such as forming molds, which do not require potentially environmentally hazardous techniques.

SUMMARY OF THE INVENTION

To the above end and others, a first aspect of the present invention relates to a method for forming a three-dimensional cavity in a corresponding structure. The method comprises providing a structure comprising a $CO_2$-insoluble material which has a three-dimensional object positioned therein. The object comprises $CO_2$-soluble material. The object is then contacted with a fluid comprising carbon dioxide to dissolve the object therein, and then the fluid is removed to form a cavity in the structure. The cavity has a shape corresponding to the shape of the three-dimensional object.

Carbon dioxide may be employed in liquid, gaseous, or supercritical form, with supercritical and liquid carbon dioxide being preferred. The $CO_2$-soluble material may be selected from various components including fluorinated components, siloxane containing components, and mixtures thereof.

In a second aspect, the present invention relates to a method of removing an adhesive material from two separate substrates.

In a third aspect, the present invention relates to a method of removing a coating material from a substrate surface portion.

In a fourth aspect, the present invention relates to a method of removing a binder from a plurality of particles.

DETAILED DESCRIPTION OF THE INVENTION

The present invention will now be described more fully hereinafter with reference to preferred embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

The present invention is directed to a method of forming a three-dimensional cavity in a corresponding structure. Specifically, the method includes providing a structure comprising $CO_2$-insoluble material, wherein the structure has a three-dimensional object positioned therein. The three-dimensional object comprises $CO_2$-soluble material. The object is then contacted with a fluid comprising carbon dioxide to. dissolve the object in the fluid. The fluid is then removed to form a cavity in the structure. The cavity has a shape corresponding to the shape of the three-dimensional object.

For the purpose of the present invention, the fluid includes carbon dioxide in a liquid, gaseous, or supercritical phase. If liquid $CO_2$ is used, the temperatures employed during the process are preferably below 31° C. If gaseous $CO_2$ is used, it is preferred that the phase be employed at high pressure. As used herein, the term "high pressure" generally refers to $CO_2$ having a pressure from about 5 to about 1000 bar. In a preferred embodiment, the $CO_2$ is utilized in a "supercritical" phase. As used herein, "supercritical" means that a fluid medium is at a temperature that is sufficiently high that it cannot be liquefied by pressure. The thermodynamic properties of $CO_2$ are reported in Hyatt, *J. Org. Chem.* 49: 5097–5101 (1984); therein, it is stated that the critical temperature of $CO_2$ is about 31° C.

The fluid can include components other than carbon dioxide, the selection of which can be ascertained by the skilled artisan. Other components may include, but are not limited to, aqueous and organic liquid co-solvents.

The three-dimensional object may exist in any suitable shape or figure. Preferably, the object is present as a form or template. The object includes material which is $CO_2$-soluble (i.e., "$CO_2$-philic"). The $CO_2$-soluble material may contain various substituents such as a fluorinated component, a siloxane-containing component, or a mixture of the above. Exemplary fluorinated components include, for example, fluorinated polymers or oligomers. As used herein, a fluoropolymer has its conventional meaning in the art and should also be understood to include low molecular weight oligomers (degree of polymerization greater than or equal to 2). See generally Banks et al. *Organofluorine Compounds: Principles and Applications* (1994) and fluorine-containing polymers, 7 Encyclopedia of Polymer Science and Engineering 256 (H. Mark et al. Eds., 2d Ed. 1985). Exemplary fluoropolymers and their oligomers are those formed from monomers such as fluoroacrylate monomers including 2-(N-ethylperfluorooctanesulfonamido) ethyl acrylate (EtFOSEA), 2-(N-ethylperfluorooctane-sulfonamido) ethyl methacrylate (EtFOSEMA), 2-(N-methyl-perfluorooctanesulfonamido) ethyl acrylate (MeFOSEA), 2-(N-methylperfluorooctanesulfonamido) ethyl acrylate (MeFOSEA), 2-(N-methylperfluorooctane sulfonamido) ethyl methacrylate (MeFOSEMA), 1,1'-dihydro perfluorooctyl acrylate (FOA), 1,1'-dihydro perfluorooctyl methacrylate (FOMA): 1,1',2,2'-tetrahydro perfluoroalkyl acrylates and methacrylates; fluorostyrene monomers such as α-fluorostyrene, and 2,4,6-trifluoromethylstyrene; fluoroalkylene oxide monomers such as a hexafluoropropylene oxide and perfluorocyclohexene oxide; fluoroolefins such as tetrafluoroethylene, vinylidine fluoride, and chlorotrifluoroethylene; fluorinated alkyl vinyl ether monomers such as perfluoro(propyl vinyl ether) and perfluoro(methylvinyl ether); and the copolymers thereof with suitable comonomers (e.g. oxygen as in the photooxidative polymerization of fluorinated monomers) wherein the comonomers may be fluorinated or unfluorinated. Mixtures of any of the above can be used. Copolymers formed from any of the monomers recited herein may also be employed. Exemplary copolymers include, for example, copolymers of FOMA and methyl methacrylate.

Siloxane-containing segments may include, for example, poly(dimethyl siloxane) or its derivatives. Exemplary siloxane containing compounds include, but are not limited to, alkyl, fluoroalkyl, and chloroalkyl siloxanes, along with mixtures thereof. Copolymers of any of the above may also be utilized.

In accordance with the invention, the three-dimensional object is positioned in a corresponding surrounding structure. The structure is made up of essentially $CO_2$-insoluble material. Various materials may be used, and the selection of those is well known by the skilled artisan. The $CO_2$-insoluble materials include, for example, organic and inorganic polymers, ceramics, glasses, metals, and composite mixtures thereof. The structure may be employed in combination with the object according to various accepted techniques. In one embodiment for example, the structure may be made of sand and the object is encapsulated in the sand. In another embodiment, the structure includes ceramic material which is coated onto the object.

The steps involved in the present invention can be carried out using apparatus and conditions known to those skilled in the art. Typically, the $CO_2$-soluble material is employed for a purpose of assembly in the three-dimensional object. Specifically, in investment casting, the object may exist as a template of a metal part to be made.

The $CO_2$-soluble material can be processed into a three-dimensional object using various methods including, for example, blow molding, injection molding, machining, extruding, and the like. Subsequently, the object is incorporated into a surrounding structure. As indicated herein, the object can be encapsulated in sand, or coated with a suitable ceramic material to facilitate the formation of a mold. The mold is then contacted with the fluid containing carbon dioxide to dissolve the object therein. The fluid is then removed so as to form a cavity in the structure which corresponds to the shape of the three-dimensional object. The three-dimensional cavity may serve as a mold for a number of applications. For example, the mold can be employed in producing components and parts useful in electronic, ceramic, and automotive applications, as well as in other various machining and manufacturing operations. In one specific embodiment, the three-dimensional cavity is employed as a metal casting mold.

Advantageously, the fluid may be separated from the object containing $CO_2$-soluble material using a suitable method or technique. Accordingly, the fluid may be reused in subsequent cavity-forming operations, or the $CO_2$-soluble material which was removed may be reprocessed and reused/refired into a three-dimensional object.

In another aspect, the present invention relates to a method of removing an adhesive material from two separate substrates. The method includes providing an adhesive material which secures the first and second substrates to each other. The adhesive material includes $CO_2$-soluble material. The adhesive material is then contacted with a fluid which includes carbon dioxide to dissolve the adhesive material therein. The first substrate is then separated from the second substrate to remove the adhesive material from the two substrates. At this time, the fluid is typically separated from the first and second substrates.

The adhesive material may be formed from any of the $CO_2$-soluble materials disclosed, but not limited to, those herein. The adhesive material may be employed on the first and second substrates which are useful in numerous applications. Such substrates may be formed from, for example, various porous and non-porous solids such as metals, glass, ceramics, synthetic and natural organic $CO_2$-insoluble polymers, synthetic and natural inorganic $CO_2$-insoluble polymers, composites, and other materials. Liquids and gel-like substances may also be used as substrates. Composites of any of the above materials are also suitable for use.

Various embodiments illustrate methods of removing adhesive materials. In one embodiment, the polymeric material is an adhesive secured to a substrate, such as that present on a household appliance. Often manufacturers have provisions to receive the appliance back after it is no longer useful in order to recycle the appliance. To disassemble the appliance such that it may be recycled, adhesives which hold appliance parts together or secure labels to substrates need to be removed. In such instances, the fluid may be applied using known apparatus to remove the adhesive from the substrate.

In another embodiment, adhesives secure two or more components together, such as part of a manufacturing process. Once the process is complete, it is often desirable to remove the adhesive by employing suitable apparatus.

The method of removing the adhesive material from two separate substrates may also include the step of separating the adhesive material from the fluid such that the fluid may be reused. The separation step may be carried out in accordance with known and accepted techniques.

In another aspect, the present invention relates to a method of removing a coating material from a substrate surface portion. The method includes providing a substrate having a coating material adhered to a surface thereof, the coating material including a $CO_2$-soluble material. The coating material is then contacted to a fluid including carbon dioxide to dissolve the coating material therein. The fluid is then separated from the substrate to remove the coating material from the substrate surface.

In one embodiment, the coating material may serve as a protective coating during application of a $CO_2$-insoluble finish material (e.g., paint) to the substrate. In this instance, the coating material is adhered to the surface portion in a predetermined pattern to provide a masked portion and an unmasked portion. The $CO_2$-insoluble material is adhered to the masked portion and the unmasked portion. The finish coating is removed from the masked portion but not the unmasked portion during the separation step.

In another embodiment, the coating material may be present on an article of manufacture to serve as a protective coating from nicking or any other type of damage that may potentially incur during handling of the article of manufacture. Preferably in this embodiment, the coating material includes a fluorinated acrylate.

The method of removing a coating material from a substrate surface portion may also further include the step of separating the coating material from the fluid such that the fluid may be reused. Any suitable technique known by the skilled artisan may be employed for this purpose.

In yet another aspect, the invention relates to a method of removing a binder from a plurality of particles. The method includes providing an object which includes a plurality of particles adhered together with a binder, the binder including $CO_2$-soluble material. The object is then contacted to a fluid which includes carbon dioxide to dissolve the binder therein. The fluid is then separated from the particles to remove the binder from the particles.

Various suitable materials may be used in the particles, such as ceramics, powdered metal, and sand. In one embodiment, the particles are ceramic particles that have been thermally treated in accordance with a technique known to the skilled artisan. The method further includes the step of subjecting the ceramic particles to a thermal treatment subsequent to the step of separating the fluid from the plurality of particles.

In another embodiment, the plurality of particles are sand. In accordance with the method of the invention, the sand becomes free flowing subsequent to the step of separating the fluid from the plurality of particles. Such an embodiment may encompass, for example, a sand recycling process such that the sand may be reused.

The present invention is explained in greater detail herein in the following examples, which are illustrative and are not to be taken as limiting of the invention.

EXAMPLE 1

Synthesis of $CO_2$-Soluble Materials

A $CO_2$-soluble material is synthesized via atom transfer radical polymerization from 1,1-dihydroperfluorooctyl methacrylate (FOMA). FOMA (167 g, 0.37 mol, purified by running through $Al_2O_3$ column) α,α,α-trifluorotoluene (120 mL as solvent), methyl-2-bromo-proprionate (411 mg, 2.5 mmol), 2,2'-dipyridyl (1.13 g, 7.2 mmol), and copper (I) bromide (350 mg, 2.4 mmol) are put into a 500 mL round bottom flask with a magnetic stir bar inside. The flask is sealed with a septum and purged with argon for ca. 15 minutes. The flask is placed in a 115° C. oil bath for eight hours then removed. Near the end of the reaction, the system appears as an opaque dispersion. After cooling the flask, the contents separate into two phases, one of polymer and one of solvent. 1H NMR spectrum of the reaction mixture verifies the structure of the $CO_2$-soluble material and shows 80% conversion corresponding to a molecular weight of 53.4 kg/mol. The mixture is made homogeneous by addition of 40 mL Freon–113. The mixture is then passed through a column of $Al_2O_3$ resulting in a transparent, light-green, free flowing solution. The polymer is precipitated into methanol, and dried in vacuo overnight to yield 120 grams of glassy white material having a glass transition temperature of approximately 50° C.

EXAMPLE 2

Synthesis of Poly(tetrahydroperfluorooctyl methacrylate)

A second $CO_2$-soluble material is synthesized via atom transfer radical polymerization from 1,1,2,2-tetrahydroperfluorooctyl methacrylate (TM). TM (150 g, 0.26 mol, purified by running a 40% solution in α,α,α-trifluorotoluene through $Al_2,O_3$ column), α,α,α-trifluorotoluene (120 mL as solvent), methyl-2-bromo-proprionate (371 mg, 2,2 mmol), 2,2'-dipyridyl (1.04 g, 7.7 mmol), and copper (I) bromide (319 mg, 2.2 mmol) are put into a 500 mL round bottom flask with a magnetic stir bar inside. The flask is sealed with a septum and purged with argon for ca. 15 minutes. The flask is placed in a 115° C. oil bath for eight hours then removed. Near the end of the reaction the system is an opaque dispersion. 1H NMR spectrum of the reaction mixture verifies the structure of the material and shows 95% conversion corresponding to a molecular weight of 63 kg/mol. The mixture is made homogeneous by addition of 20 mL Freon-113. The mixture is then passed through a column of $Al_2O_3$ resulting in a transparent, clear, free flowing solution. The polymer is precipitated into methanol, and dried in vacuo overnight to yield 100 grams of glassy white material with a melting point TM=70° C. 0.35 grams of PTM is placed in a 10 mL high pressure cell. The cloud point at 50° C. is found to be 2700 psi. Above the cloud point the polymer solution is found to be completely transparent.

EXAMPLE 3

Synthesis of Poly(FOSEMA)

Methyl-perfluorooctylsulfonamidomethacrylate, or FOSEMA, is polymerized via atom transfer radical polymerization. FOSEMA (143 g, 0.22 mol, purified by running a 40% solution in α,α,α-trifluorotoluene through $Al_2O_3$ column), α,α,α-trifluorotoluene (100 mL as solvent), methyl-2-bromo-proprionate (431 mg, 2.6 mmol), 2,2'-dipyridyl (1.22 g, 0.8 mmol), and copper (I) bromide (370 mg, 2.6 mmol) are put into a 500 mL round bottom flask with a magnetic stir bar inside. The flask is sealed with a septum and purged with argon for ca. 15 minutes. The flask is placed in a 115° C. oil bath for eight hours then removed. Near the end of the reaction the system is a translucent dispersion. 1H NMR spectrum of the reaction mixture verifies the structure of the material and shows 96% conversion corresponding to a molecular weight of 53 kg/mol. The mixture is passed through a column of $Al_2O_3$ resulting in a transparent, clear, free flowing solution. The polymer is precipitated into methanol, and dried in vacuo overnight to yield 100 grams of glassy white material.

EXAMPLE 4

Synthesis of a Random Copolymer of MMA and FOMA

A $CO_2$-soluble 1 g:4 g copolymer of methyl methacrylate (MMA) and FOMA is synthesized via atom transfer radical polymerization. FOMA (139 g, 0.30 mol, purified by running through an $Al_2O_3$ column), MMA (35 g, 0.35 mol, purified by running through an $Al_2O_3$ column), α,α,α-trifluorotoluene (100 mL as solvent), methyl-2-bromo-proprionate (434 mg, 2.6 mmol), 2.2'-dipyridyl (1.2 g, 7.7 mmol), and copper (I) bromide (373 mg, 2.6 mmol) are put into a 500 mL round bottom flask with a magnetic stir bar inside. The flask is sealed with a septum and purged with argon for ca. 15 minutes. The flask is placed in a 115° C. oil bath for eight hours then removed. Near the end of the reaction the system appears as a translucent dispersion. 1H NMR spectrum of the reaction mixture verifies the structure of the material and shows 97% conversion corresponding to a molecular weight of 65 kg/mol. The mixture is passed through a column of $Al_2O_3$ resulting in a transparent, clear, free flowing solution. The polymer is precipitated into methanol, and dried in vacuo overnight to yield 130 grams of glassy white material.

EXAMPLE 5

Solubility Determination of Poly(FOMA) in $CO_2$ 0.35 grams of PFOMA is placed in a 10 mL high pressure cell. The cloud point at 50° C. is found to be 2700 psi. Above the cloud point the polymer solution is found to be completely transparent.

EXAMPLE 6

Solubility Determination of Poly(TM) in $CO_2$ 0.35 grams of PTM is placed in a 10 mL high pressure cell. The cloud point at 50° C. is found to be 2700 psi. Above the cloud point the polymer solution is found to be completely transparent.

EXAMPLE 7

Solubility Determination of Poly(FOSEMA) in $CO_2$ 0.35 grams of PFOSEMA is placed in a 10 mL high pressure cell. The cloud point at 50° C. is found to be 3350 psi. Above the cloud point the polymer solution is found to be completely transparent.

EXAMPLE 8

Solubility Determination of Poly(FOMA-co-MMA) in $CO_2$ 0.35 grams of FOMA/MMA Copolymer is placed in a 10 mL high pressure cell. The cloud point at 50° C. is found to be 3600 psi. Above the cloud point the polymer solution is found to be completely transparent.

EXAMPLE 9

Removal of $CO_2$ Soluble Form/Template

From Metal Casting Sand Mold

The $CO_2$-soluble material (any of those described in Examples 1–4) was compression molded into a monolithic placard to create a form/template. The form/template piece was then embedded in sand within a metal casting mold. The metal casting mold was then placed into a $CO_2$ extraction unit and the $CO_2$-soluble form/template was removed out of the metal casting mold leaving a cavity suitable for use as a metal casting mold. The extracted $CO_2$-soluble plastic was quantitatively recovered as a fine powder, suitable for reuse.

EXAMPLE 10

Removal of $CO_2$ Soluble Ceramic Coated, Form/Template From Metal Casting Sand Mold Conditions similar to Example 9 were employed except that the $CO_2$-soluble form/template was coated with a ceramic coating prior to embedding it in sand to aid in the casting process.

EXAMPLE 11

Label Removal

A $CO_2$-soluble adhesive is used to secure a label to a substrate. The substrate is submerged into a $CO_2$-bath to dissolve away the adhesive which facilitates removal of the label.

EXAMPLE 12

Adhesive Removal (between two pieces of glass)

A $CO_2$-soluble adhesive is used to secure two pieces of glass together. The bonded glass assembly is submerged into a $CO_2$-bath to dissolve away the adhesive to debond and free the glass pieces.

EXAMPLE 13

Temporary Coating

A coating containing a $CO_2$-soluble polymer (any of those described in Examples 1 through 4) is removed from a substrate by submerging the coated substrate into a $CO_2$-bath. The coating is dissolved and thus readily removed from the substrate.

EXAMPLE 14

Temporary Binder

A $CO_2$-soluble binder (any of those described in Examples 1 through 4) is used to hold sand together in a preferred shape to facilitate a metals casting process or the firing of a ceramic piece. Upon completion of the casting process, the sand which contained the binder was collected and washed with $CO_2$ to remove the binder.

In the examples and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A method for forming a three-dimensional cavity in a corresponding structure comprising:

providing a structure comprising $CO_2$-insoluble material, wherein said structure has a three-dimensional object comprising $CO_2$-soluble material positioned therein, the $CO_2$-soluble material including at least one substituent selected from the group consisting of a fluorinated component, a siloxane-containing component, and mixtures thereof; then contacting said object with a fluid comprising carbon dioxide to dissolve said object in said fluid; and then removing said fluid to form a cavity in said structure, said cavity having a shape corresponding to the shape of said three-dimensional object.

2. The method according to claim 1, wherein the cavity is a cavity of a metal casting mold.

3. The method according to claim 1, wherein said structure includes sand which encapsulates said object.

4. The method according to claim 1, wherein said structure includes ceramic material coated onto said object.

5. The method according to claim 1, wherein said object is a form or template.

6. The method according to claim 1, wherein said fluid further comprises a co-solvent.

7. The method according to claim 1, wherein said fluorinated component is selected from the group consisting of a fluorinated polymer, oligomer, and copolymer, said fluorinated component being formed from monomers selected from the group consisting of 2-(N-ethylperfluorooctanesulfonamido) ethyl acrylate, 2-(N-ethylperfluorooctanesulfonamido) ethyl methacrylate, 2-(N-methylperfluorooctanesulfonamido) ethyl acrylate, 2-(N-methylperfluorooctanesulfonamido) ethyl acrylate, 2-(N-methylperfluorooctanesulfonamido) ethyl methacrylate, 1,1'-dihydroperfluorooctylacrylate, 1,1'-dihydroperfluorooctyl methacrylate, 1,1'and 2,2'-tetrahydroperfluoroalkyl acrylates and methacrylates, α-fluorostyrene, 2,4,6-trifluoromethylstyrene, hexafluoropropylene oxide and perfluorocyclohexene oxide, tetrafluoroethylene, vinylidine fluoride, chlorotrifluoroethylene, perfluoro(propyl vinyl ether), perfluoro(methyl vinyl ether), and mixtures thereof.

8. The method according to claim 1, wherein said siloxane-containing component is selected from the group consisting of alkyl siloxanes, fluoroalkyl siloxanes, chloroalkyl siloxanes, and mixtures thereof.

9. The method according to claim 1, wherein the fluid comprises supercritical carbon dioxide.

10. The method according to claim 1, wherein the fluid comprises gaseous carbon dioxide.

11. The method according to claim 1, wherein the fluid comprises liquid carbon dioxide.

12. The method according to claim 1, further comprising the step of separating said $CO_2$-soluble material from said fluid such that said fluid may be reused.

* * * * *

UNITED STATES PATENT AND TRADEMARK OFFICE

CERTIFICATE OF CORRECTION

PATENT NO. : 5,860,467
APPLICATION NO. : 08/753938
DATED : January 19, 1999
INVENTOR(S) : DeSimone et al.

It is certified that error appears in the above-identified patent and that said Letters Patent is hereby corrected as shown below:

Column 1, Line 9: Insert:

--STATEMENT OF FEDERAL SUPPORT

Aspect of this invention were supported with funding provided under Grant No. DMR-9350334 awarded by the National Science Foundation. The United States Government has certain rights in this invention.--

Signed and Sealed this

Third Day of June, 2008

JON W. DUDAS
*Director of the United States Patent and Trademark Office*

UNITED STATES PATENT AND TRADEMARK OFFICE

CERTIFICATE OF CORRECTION

PATENT NO. : 5,860,467
APPLICATION NO. : 08/753938
DATED : January 19, 1999
INVENTOR(S) : DeSimone et al.

It is certified that error appears in the above-identified patent and that said Letters Patent is hereby corrected as shown below:

Column 1, Line 9: Insert:

--STATEMENT OF FEDERAL SUPPORT

Aspects of this invention were supported with funding provided under Grant No. DMR-9350334 awarded by the National Science Foundation. The United States Government has certain rights in this invention.--

This certificate supersedes the Certificate of Correction issued June 3, 2008.

Signed and Sealed this

Twelfth Day of August, 2008

JON W. DUDAS
*Director of the United States Patent and Trademark Office*